US005200570A

United States Patent [19]

Kawamura

[11] Patent Number: 5,200,570

[45] Date of Patent: Apr. 6, 1993

[54] KEY-TOUCH STATE DETECTION DEVICE FOR AN AUTOMATIC PERFORMANCE PIANO

[75] Inventor: Kiyoshi Kawamura, Hamamatsu, Japan

[73] Assignee: Yamaha Corporation, Hamamatsu, Japan

[21] Appl. No.: 558,569

[22] Filed: Jul. 27, 1990

[30] Foreign Application Priority Data

Aug. 8, 1989 [JP] Japan ..... 1-205487

[51] Int. Cl.[5] ..... G10H 1/02

[52] U.S. Cl. ..... 84/737; 84/745

[58] Field of Search ..... 84/23 C, 723, 724, 742-745, 84/115, 19-23, 462, 626, 662, 701, 703, 737, DIG. 7

[56] References Cited

U.S. PATENT DOCUMENTS

| | | | |
|---|---|---|---|
| 4,080,863 | 3/1978 | Groeschel | 84/ |
| 4,592,262 | 6/1986 | Yang | 84/115 |
| 4,593,592 | 6/1986 | Stahnke | 84/21 |
| 4,736,662 | 4/1988 | Yamamoto | 84/724 |
| 4,756,223 | 7/1988 | Murakami | 84/21 |
| 4,913,026 | 4/1990 | Kaneko et al. | 84/21 |
| 4,970,928 | 11/1990 | Tamaki | 84/21 |
| 4,979,423 | 12/1990 | Watanabe | 84/DIG. 7 X |
| 5,012,715 | 5/1991 | Matsunaga et al. | 84/724 |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

A key touch state detection device for an automatic performance piano includes at least one sensor for detecting whether or not a position of the hammer striking a string in an interlocked motion with movement of a key coincides with a predetermined hammer stop position and also whether or not a position of the hammer coincides with a predetermined position or positions in the vicinity of the string. The device includes also a circuit responsive to the detection output of the sensor for determining, when the hammer is recognized to be in a return process, a timing at which result of detection of the hammer stop position has changed as a timing of release of key. Depression and release of the key and the string striking speed of the hammer (key-touch strength) are detected by the hammer position sensor with resulting simplification in the structure of the device and improved accuracy in the detection of a key-touch state.

3 Claims, 7 Drawing Sheets

KEY-TOUCH STATE DETECTION DEVICE FOR AN AUTOMATIC PERFORMANCE PIANO

BACKGROUND OF THE INVENTION

This invention relates to a key-touch state detection device for an automatic performance piano with improved accuracy in detection of a key-touch state.

As operation modes of an automatic performance piano, there are a record mode in which performance by a performer is recorded and an automatic performance mode in which an automatic performance is made in accordance with recorded performance information or performance information supplied from an outside source. For recording a performance by a performer in the record mode, it is necessary to measure the speed at which each hammer strikes a string, a time point at which a key has been depressed and a time point at which the depressed key has been released and convert these data to electric signals for subsequent necessary processing. This will be described in detail with reference to FIG. 4 below.

In FIG. 4, an automatic performance piano 71 has a keyboard including keys 73, a string striking mechanism 77 which transmits the movement of each key 73 to a hammer 75, a string 79 which is struck by the hammer 75, a damper 78 for restraining vibration of the string 79, a pedal mechanism (not shown) and a pedal drive device (not shown) for driving this pedal mechanism.

The key 73 is pivotable about a balance pin 81 and, when the key 73 has been depressed or pivoted by an upward movement of a plunger in a solenoid 83, the movement of the key 73 is transmitted to the hammer 75 and the damper 78 through the string striking mechanism 77. The damper 78 thereby is released from the string 79 and the hammer is pivoted counterclockwise as viewed in the figure to strike the string 79.

A key sensor 89 is provided under the key 73 to detect depression and release of the key 73.

A shutter 76 is secured to the hammer 75 and a hammer sensor 74 is provided within a moving range of the shutter 76. The hammer sensor 74 detects the moving speed of the shutter 76 (i.e., the moving speed of the hammer 75). A controller 96 records performance information in response to detection signals produced by the key sensor 89 and the hammer sensor 74 and drives the solenoid 83 and the pedal drive device (not shown) in response to the recorded performance information (or performance information supplied from an outside source).

FIG. 5 is a side view of an essential portion of FIG. 4. In FIG. 5, a recess is formed in the upper portion of foremost end portion 76*a* of the shutter 76. In the hammer sensor 74, there are provided a couple of photo-interrupters 74*a* and 74*b* with a predetermined interval therebetween.

In the above described construction, when the key 73 (FIG. 4) has been depressed and the hammer 75 and the shutter 76 are pivoted counterclockwise as viewed in the figure, the foremost end portion 76*a* of the shutter 76 shields light entering the photo-interrupter 74*a* at position C of the hammer. As the hammer 75 and the shutter 76 are further pivoted, the recessed surface 76*b* shields light entering the photo-interrupter 74*b* at position D of the hammer which strikes the string 79 at this position.

Accordingly, by measuring time from shielding of light in the photo-interrupter 74*a* till shielding of light in the photo-interrupter 74*b*, the speed of the hammer 75 at this time (i.e., time immediately before the string 79 is struck by the hammer 75) can be obtained. This speed is recorded in the controller 96 as key-touch strength.

As described above, in the prior art automatic performance piano, timings of depression and release of a key are detected by the key sensor 89 and the speed of striking of the string is detected by the hammer sensor 74.

In the prior art automatic performance piano, however, it is necessary to provide one sensor under the key and the other sensor on the hammer and this requires a number of assembling steps and, besides, requires a long time in binding wirings with resulting increase in the cost. Moreover, since the stroke of the key is relatively small, it is difficult to adjust the location of the key sensor 89.

It is, therefore, an object of the invention to provide a key-touch state detection device for an automatic performance piano which has a simplified structure by having a sensor or sensors provided only on the hammer side and which can readily and accurately detect the key-touch state.

SUMMARY OF THE INVENTION

For achieving the above described object of the invention, the key touch state detection device according to the invention comprises hammer position detection means for detecting whether or not a position of a hammer striking a string in an interlocked motion with movement of a key coincides with a predetermined hammer stop position and also whether or not a position of the hammer coincides with a predetermined position or positions in the vicinity of the string and providing results of the detection, and determination means responsive to the results of the detection by the hammer position detection means for determining, when the hammer is recognized to be in a return process on the basis of state of change in the results of the detection by the hammer position detection means, a timing at which the result of detection of the hammer stop position has changed as a timing of release of the key.

According to the invention, as a key has been depressed and the hammer being pivoted toward the string has reached the respective predetermined positions, the results of the detection change and the string striking speed of the hammer and depression of the key are thereby detected. In the return process of the hammer after striking of the string, when the hammer being pivoted away from the string has reached the predetermined hammer stop position, the results of the detection change. When the key has been released, the hammer leaves the hammer stop position and the results of the detection change again. The determination means determines the timing at which the result of detection of the hammer stop position has changed as the timing of release of the key.

Since depression and release of the key and the string striking speed of the hammer (key-touch strength) can be detected by the hammer position detection means, the provision of the key sensor and the hammer sensor in two separate locations as in the prior art device is obviated and therefore the structure of the device can be simplified.

Moreover, since detection signals are obtained by detecting the movement of the hammer which is much larger than the stroke of the key, the adjustment of the position of the hammer position detection means is much easier and the key-touch state can be more accurately detected than in the key sensor in the prior art device. It is a matter of course that the key sensor can be used with the invention to play back a piano performance by a player also more accurately.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
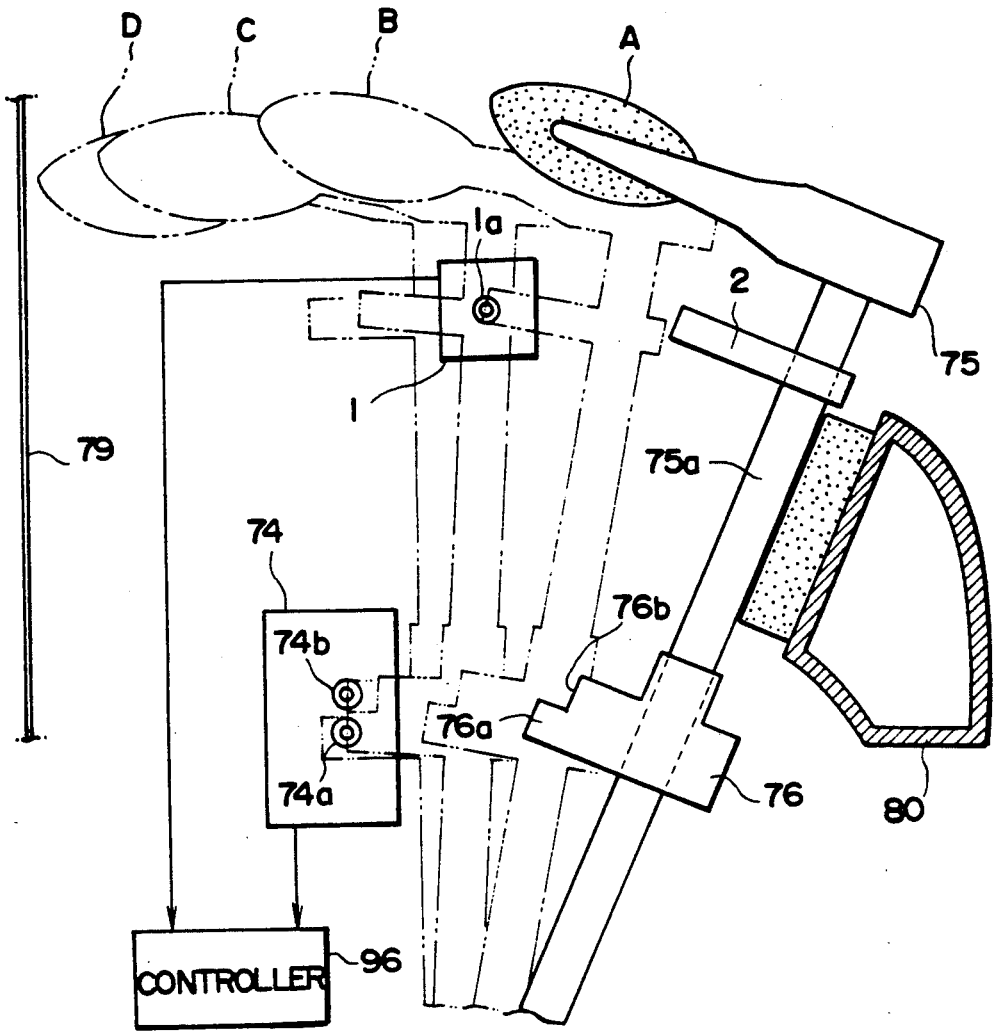
FIG. 1 is a side view of an embodiment of the invention.
Figure 4:
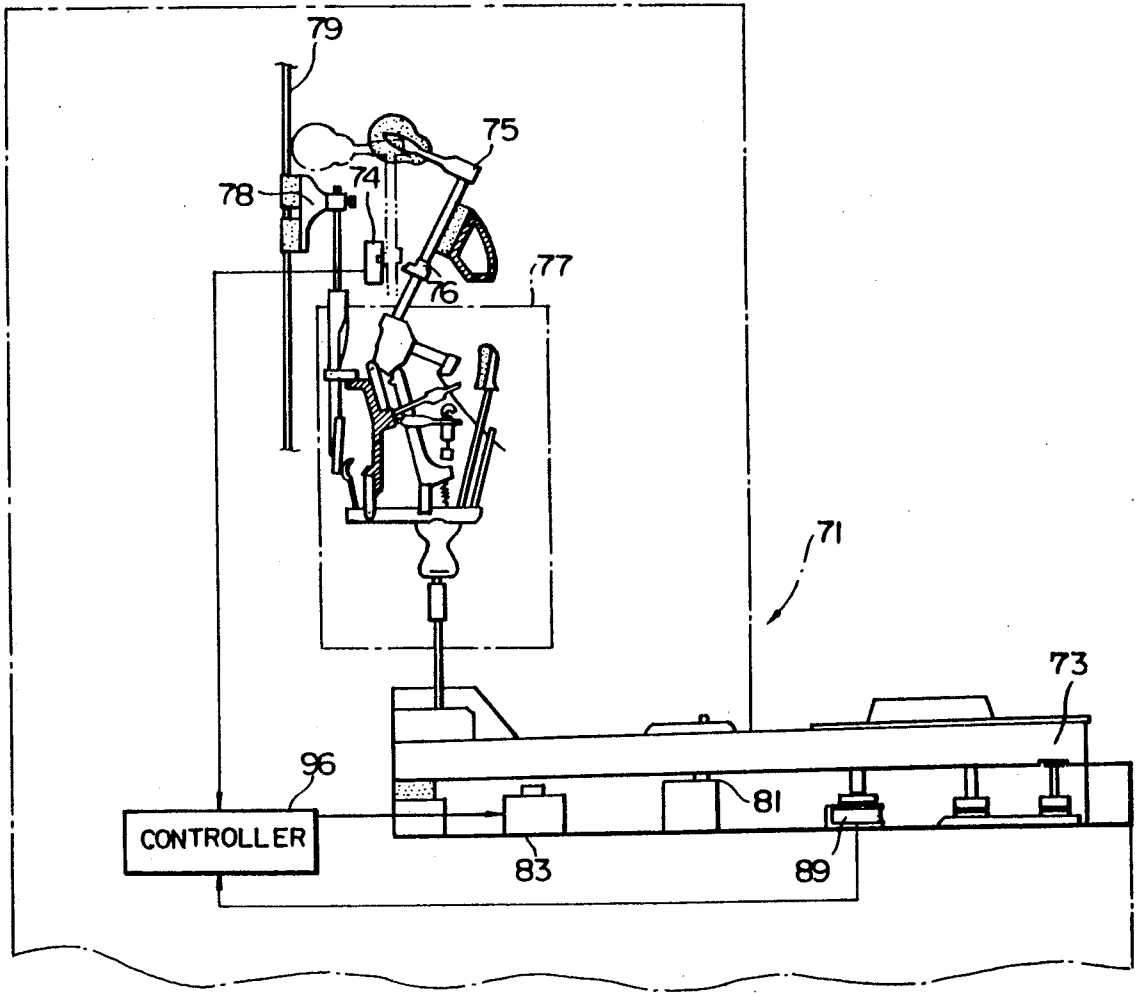
FIG. 4 PRIOR ART
FIG. 4 is a sectional side view of a prior art automatic performance piano.
Figure 5:
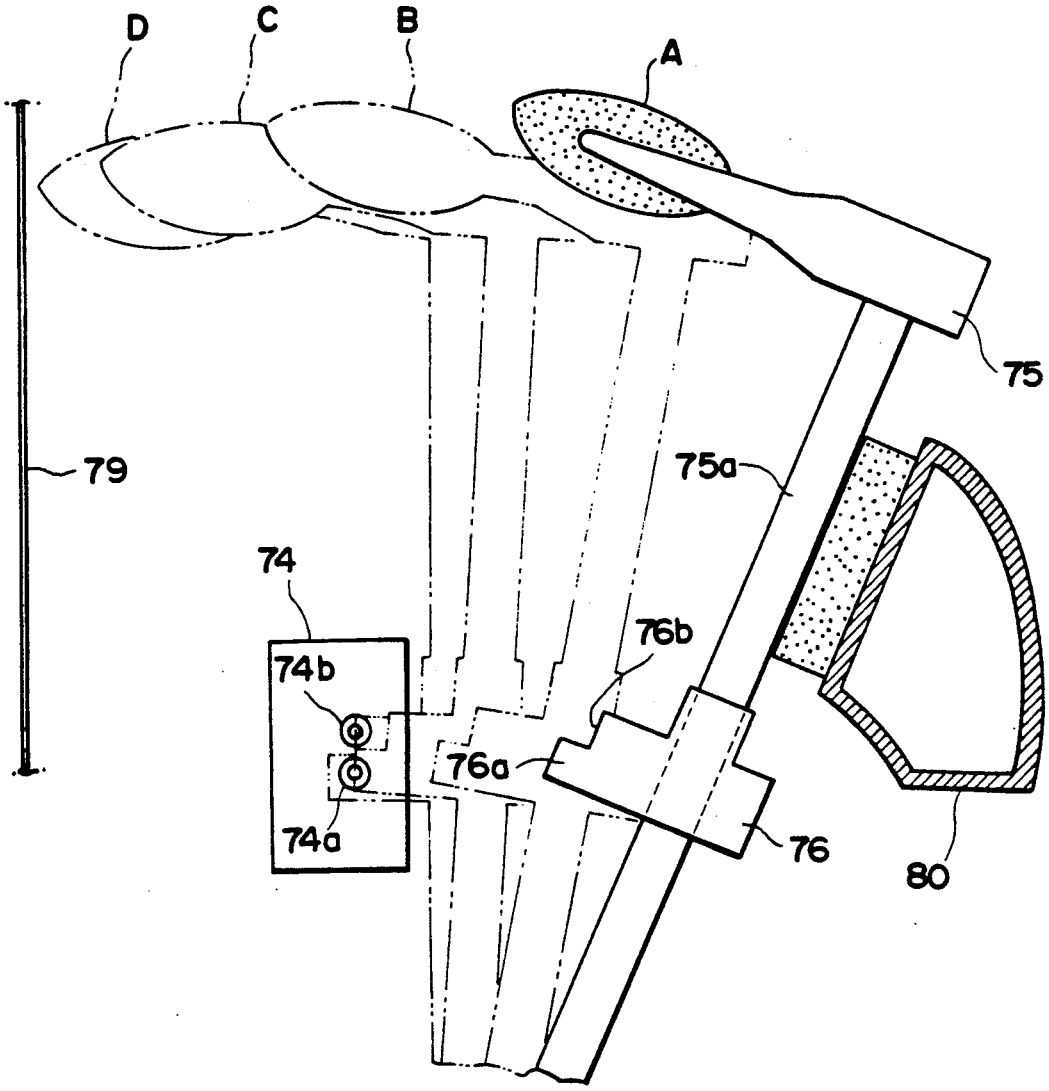
F I G. 5 PRIOR ART
FIG. 5 is a side view of an essential portion of FIG. 4.

Referring to FIG. 1, an embodiment of the invention will be described. In the figure, the same component parts as those shown in FIGS. 4 and 5 are designated by the same reference numerals and detailed description of these component parts will be omitted.

A shutter 2 is secured to a hammer shank 75*a* of a hammer 75 in such a manner that it projects toward a string 79 at a location above a shutter 76. A position sensor 1 is mounted in the vicinity of a moving path of the hammer 75 such as on a frame of the key-touch detection device and includes a photo-interrupter 1*a*. This photo-interrupter 1*a* is provided in such a manner that it is shielded from light when the hammer 75 is located at a position on the left side of position B as viewed in FIG. 1 and it is not shielded from light when the hammer 75 is located at a position on the right side of the position B.

The position B constitutes a hammer stop position. an arrangement is made in such a manner that, after striking of the string 79 by the hammer 75 by depression of a key 73 (see FIG. 4), the clockwise return movement of the hammer 75 as viewed in the figure beyond the position B is prevented unless the key 73 is released. More specifically, depression of the key 73 when the hammer is at a position A causes the hammer 75 to be pivoted counterclockwise, passing positions B, C and D one by one, and strike the string 79 after passing the position D. After striking the string 79, the hammer 75 returns to the position B, passing the positions D and C. Upon release of the key 73, the hammer 75 returns to the position A. As a result, the timing at which the shielding of light in the photo-interrupter 1*a* ceases coincides with the timing of release of the key 73 so that the timing of release of the key 73 can be detected by the photo-interrupter 1*a*. Further, the timing of depression of the key 73 approximately coincides with the timing at which light is shielded in the photo-interrupter 1*a*, the timing of depression of the key 73 can be detected by detecting this timing of shielding of light. In a typical piano, the position of the hammer 75 when the key 73 has been depressed by about 4.5 mm corresponds to the hammer stop position B. An error between the timing of release of the key 73 detected by the position sensor 1 and the actual timing of the key release is on the order of ±50 msec in a range from pp to ff and about a quarter of this value in a normally used range from pp to mf. An error of this order will not cause any practical problem.

In the present embodiment, a key release detection signal from the position sensor 1 and a key depression detection signal and a string striking speed signal from the hammer sensor 74 are supplied to a controller 96. There is no sensor (such as the key sensor 89 in FIG. 4) provided under the key 73.

In other respects, the structure of the key-touch detection device according to this embodiment is the same as the prior art device shown in FIG. 4.

Since each detection signal is obtained by detecting the movement of the hammer which is relatively large as compared with the stroke of the key 73, adjustment of the respective sensors is easy and the key-touch state can be accurately detected. Besides, since all sensors are provided in the vicinity of the moving path of the hammer 75 and no sensor is provided under the key 73, the number of assembling steps can be reduced as compared with the prior art device.

The shutters 2 and 76 which shield light in the corresponding photo-interrupters 1*a* and 74*a*, 74*b* can be made of a very thin plate and, therefore, they are so light that they never adversely affect the key touch on the key 73.

Figure 2:
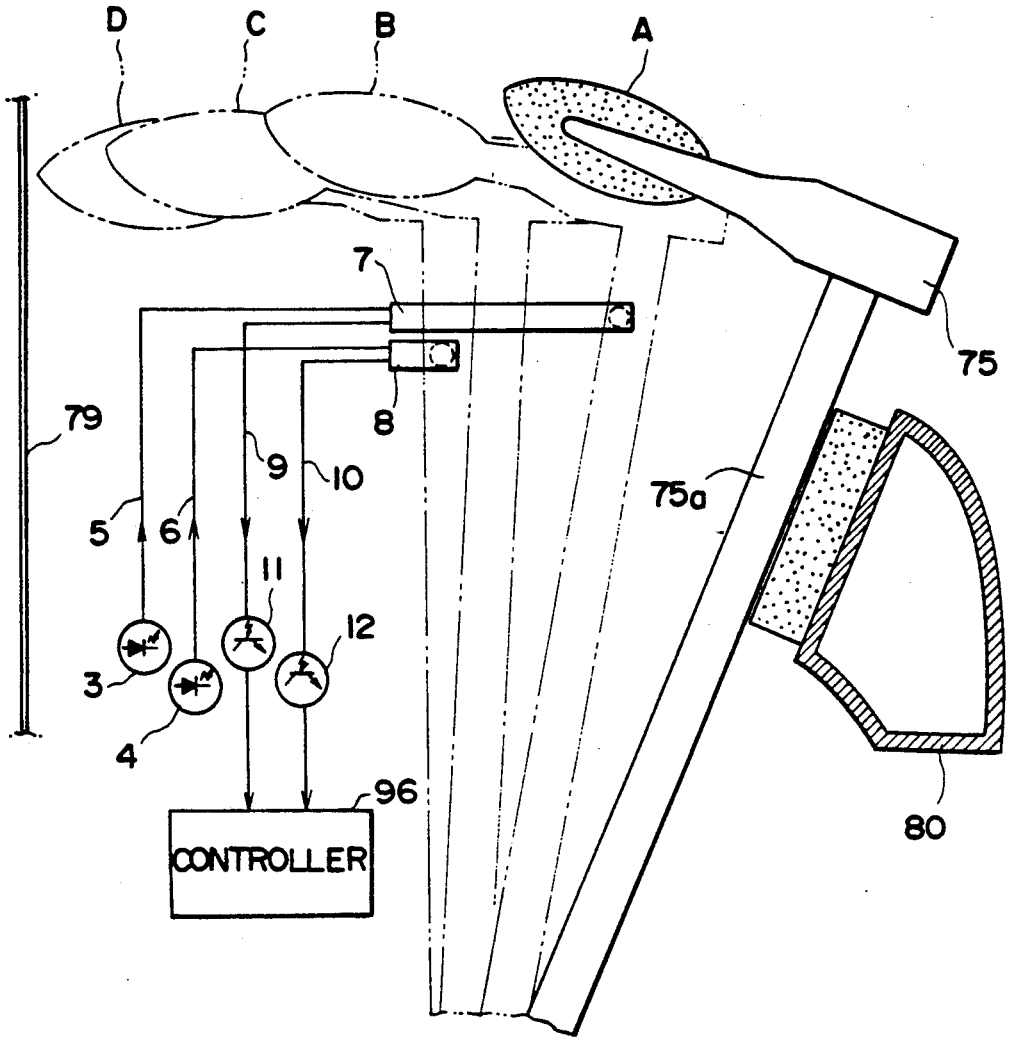
FIG. 2 is a side view of another embodiment of the invention.

Another embodiment of the invention will now be described with reference to FIG. 2. In FIG. 2, the same components as those in FIGS. 1, 4 and 5 are designated by the same reference characters and detailed description thereof will be omitted.

In the figure, light-emitting elements 3 and 4 supply light to hammer sensors 7 and 8 through optical fibers 5 and 6. The hammer sensors 7 and 8 will be described in detail with reference to FIG. 3 which is a plan view showing the hammer sensor 8 with a part thereof being removed.

Figure 3:
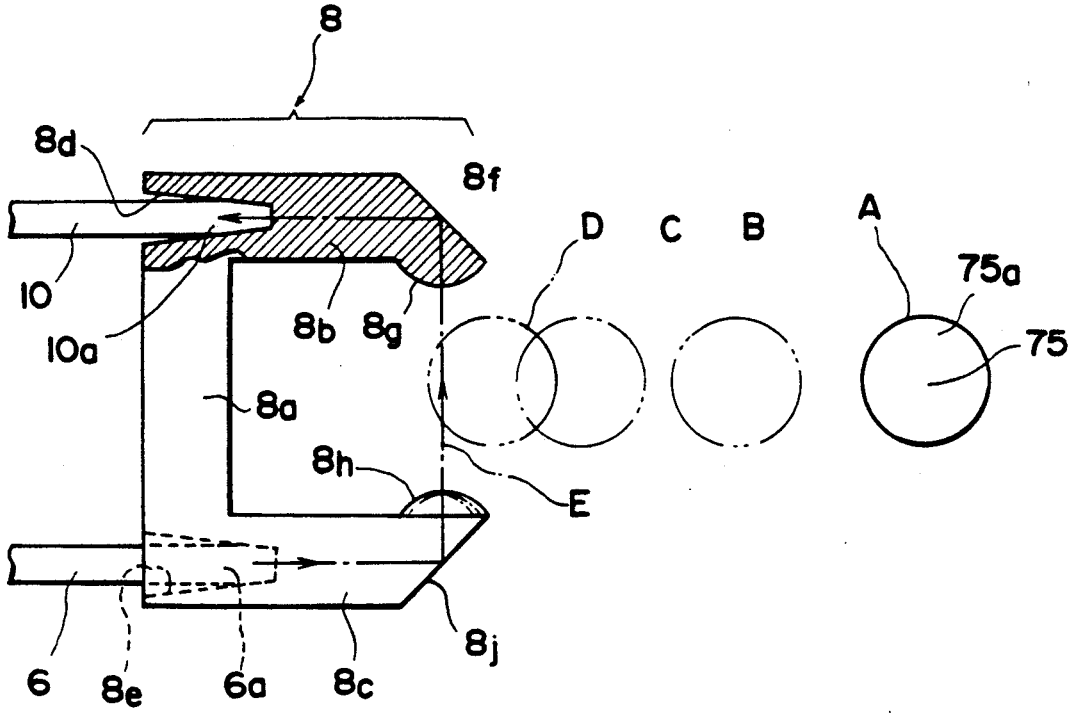
FIG. 3 is a plan view of a hammer sensor 8 shown with a part thereof being removed.

In FIG. 3, the hammer sensor 8 includes a bar-like member 8*a* made of transparent synthetic resin and lateral members 8*b* and 8*c* formed integrally with the bar-like member 8*a* and extending rightwardly from the upper and lower ends of the bar-like member 8*a* as viewed in the figure. The bar-like member 8*a* and the lateral members 8*b* and 8*c* constitute a sensor main body. In the left end portions of the lateral members 8*b* and 8*c* are formed frust-conical (frustrum of a cone shaped) holes 8*d* and 8*e* each having a gradually reduced diameter toward the bottom thereof. Foremost end portions 10*a* and 6*a* of the optical fibers 10 and 6 are formed to a frust-conical (frustrum of a cone) shape conforming to the holes 8*d* and 8*e* and fitted in the holes 8*d* and 8*e*. The right upper end portion of the lateral member 8*b* is formed in a slanting surface at an angle of about 45 degrees to form a recess 8*f*. The lower right end portion of the lateral member 8*b* projects downwardly to form a partial sphere which constitutes a lens portion 8*g*. Likewise, the right upper and lower end portions of the lateral member 8*c* are formed with a lens portion 8*h* and a recess 8*j* which respectively form a pair with the lens portion 8*g* and the recess 8*f*.

According to this construction, when the hammer 75 is located at a position, A, B or C in FIG. 3, light radiated from the optical fiber 6 is supplied to the optical fiber 10 through a path E. That is, the light radiated from the optical fiber 6 is transmitted rightwardly through the lateral member 8*c*, reflected upwardly at the recess 8*j*, focused through the lens portions 8*h* and 8*g*, reflected leftwardly at the recess 8*f* and supplied to the optical fiber 10.

When the hammer 75 is located at a position D in FIG. 3, the light radiated from the optical fiber 6 is interrupted by the hammer shank 75*a* of the hammer 75 and therefore is not supplied to the optical fiber 10.

Referring to FIG. 2, the hammer sensor 7 is of a similar construction to the hammer sensor 8 (excepting that lateral portions corresponding to the lateral members 8*b* and 8*c* of the hammer sensor 8 are longer than the lateral members 8*b* and 8*c*). When the hammer 75 is located at a position A, C or D, light radiated from the optical fiber 5 is supplied to the optical fiber 9 whereas when the hammer 75 is located at a position B, the light is interrupted by the hammer shank 75*a* of the hammer 75.

The light supplied to the optical fibers 9 and 10 is converted to an electrical signal by light-receiving elements 11 and 12 and thereafter is supplied to the controller 96. In the present embodiment, the shutters 76 and 2 of the embodiment shown in FIG. 1 are not provided. Otherwise, the embodiment of FIG. 2 is of the same construction as the embodiment of FIG. 1.

The operation of the embodiment of FIG. 2 will now be described.

In FIG. 2, when the key 73 (FIG. 4) has been depressed, the hammer 75 is pivoted through the positions A, B, C and D to strike the string 79. The controller 96 detects timing at which light is shielded in the hammer sensor 7 and timing at which light is shielded in the hammer sensor 8 and calculates and stores an average speed of the hammer 75 between the points B and D, i.e., the string striking strength. The controller 96 stores also a timing at which light is shielded in the hammer sensor 8 as the key depression timing. Then, upon striking the string, the hammer 75 is pivoted to the position B, i.e., the hammer stop position, where light is shielded again in the hammer sensor 7. Upon release of the key 73, the hammer 75 is pivoted to the position A where shielding of light in the hammer sensor 7 ceases. This timing at which the shielding of light has ceased is stored in the controller 96 as the key release timing.

According to the embodiment of FIG. 2, two sensors 7 and 8 are provided for the hammer 75. The number of the sensor elements is reduced by one as compared with the embodiment of FIG. 1 which requires three sensor elements (the photo-interrupters 1*a*, 74*a* and 74*b*). Further, the shutters 2 and 76 are obviated so that a process of providing these shutters is obviated. Since the light emitting elements 3 and 4 and the light-receiving elements 11 and 12 can be mounted in a punted circuit board, there is no substantial increase in the process caused by addition of these elements. Accordingly, the embodiment of FIG. 2 has the benefit of decreased number of processes in assembling the key-touch detection device.

In the embodiments of FIGS. 1 and 2, the position sensor 1 or the hammer sensor 7 may be provided on a hammer rail 80. This arrangement has the advantage that, when the hammer rail is pivoted to approach the string 79 during depression of a soft pedal or a mute mode, the relative positional relation between the hammer shank 75*a* and the respective sensors can be maintained.

Another embodiment of the invention in which the position of the hammer is detected as continuous data with a single sensor means employing an oscillator will be described with reference to FIGS. 6 through 10 below. In these figures, the same component parts as those shown in FIGS. 1, 4 and 5 are designated by the same reference characters and detailed description thereof will be omitted.

Figure 8:
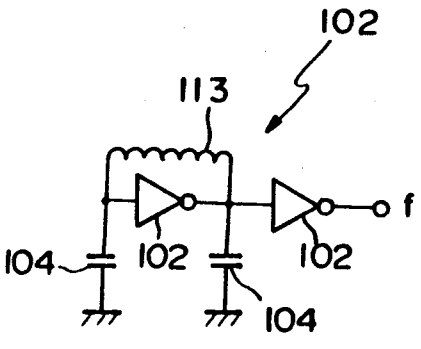
FIG. 8 is a circuit diagram showing the basic principle of measurement used in the same embodiment.
Figure 7B:
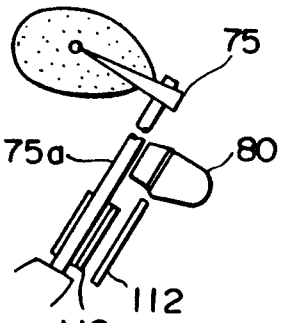
FIGS. 7A and 7B are views schematically showing the same embodiment of the invention.
Figure 7A:
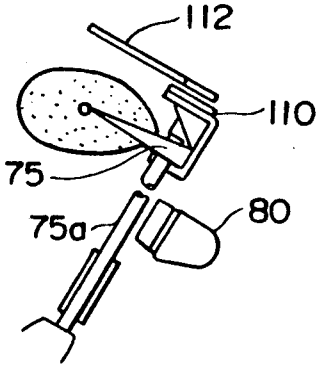
Figure 6:
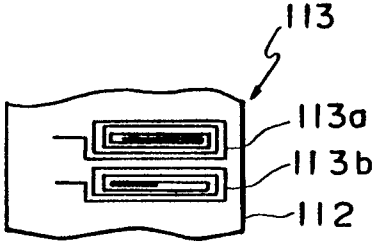
FIG. 6 is a plan view of a coil used in another embodiment of the invention.

In this embodiment, a sensor 100 (FIG. 9) includes a Colpitts oscillator 102 as shown in FIG. 8 and a metal member 110 (FIGS. 7A and 7B) provided on the hammer 75. The Colpitts oscillator 102 includes a coil 113, inverters 4 and capacitors 104 and, as the inductance of the coil 113 changes, the ocillation output of this oscillator 102 changes. The coil 113 in this embodiment is made of coil patterns 113*a* and 113*b* formed on a printed circuit board 112 (FIG. 6) provided in the vicinity of the moving path of the hammer 75 as shown in FIGS. 7A and 7B. The metal member 110 is made of a thin plate of aluminum or iron and is secured at the top of the hammer shank 75*a* as shown in FIG. 7A or at a position on the hammer shank 75A near the hammer rail 80 as shown in FIG. 7B so as to oppose the coil 113.

Figure 9:
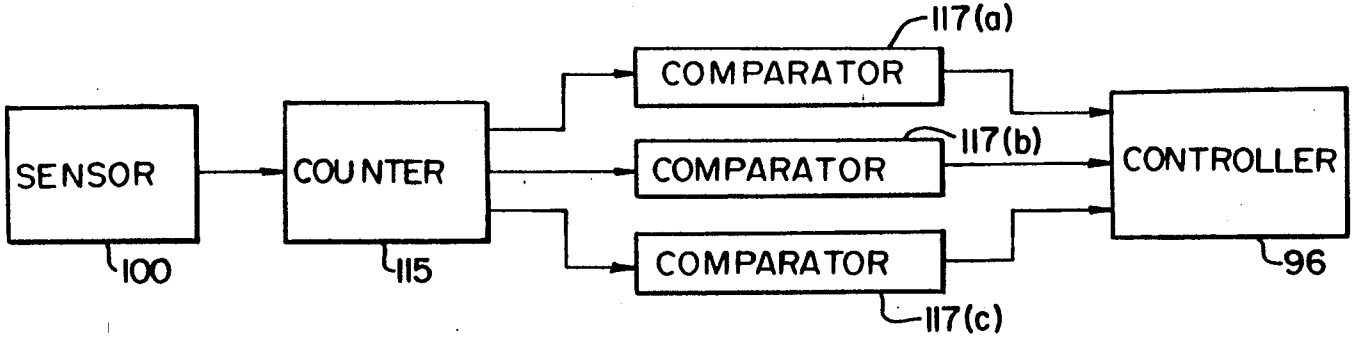
FIG. 9 is a block diagram showing an example of the circuit used in the same embodiment.
Figure 10:
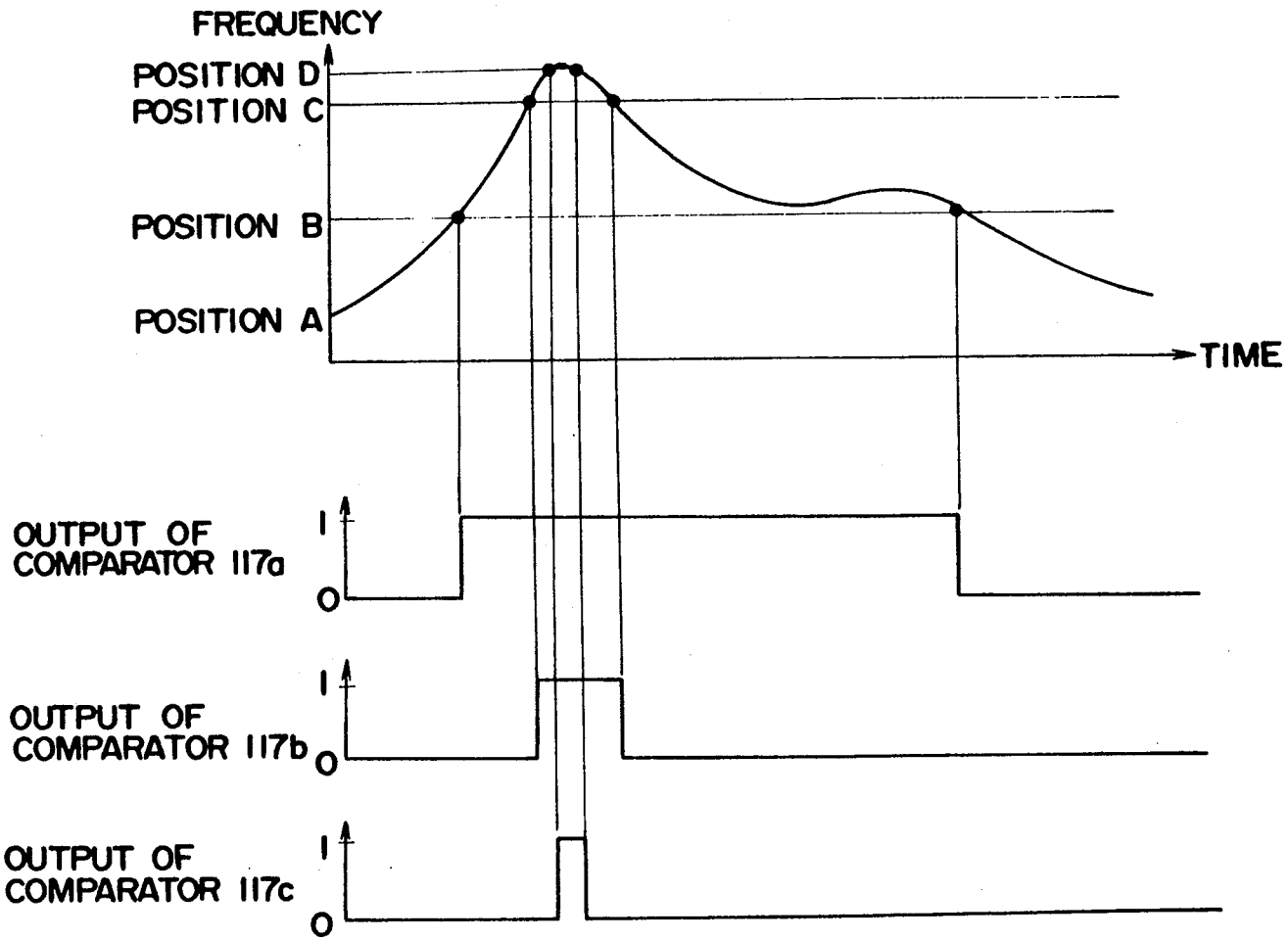
FIG. 10 is a graph showing outputs of the comparators of the circuit of FIG. 9 at respective measuring points.

Referring to FIG. 9, a counter 115 is connected to the sensor 100 to count the frequency of the oscillation output from the sensor 100. A plurality of comparators 117*a*, 117*b* and 117*c* are connected to the counter 115 to receive the counted frequency from the counter 115. Frequencies produced when the hammer 75 is at the positions B, C and D are previously measured and the frequency for the position B is stored in the comparator 117*a*, the frequency for the position C in the comparator 117*b* and the frequency for the position D in the comparator 117*c*, respectively as reference value. These comparators 117*a* to 117*c* produce an output "1" when the value of the input frequency is equal to or larger than the reference value and an output "0" when the input frequency is smaller than the reference value. The results of comparison by the comparators 117*a* to 117*c* are supplied to a controller 96 which processes the input data in the same manner as in the previously described embodiments.

The operation of this embodiment will be described below.

As the key 73 has been depressed and the hammer 75 thereby is pivoted from the position A to the position D to strike the string 79, the distance between the metal plate 110 secured on the hammer 75 and the coil 113 provided in the vicinity of the moving path of the hammer 75 changes and this change causes change in the inductance of the coil 113. As the inductance of the coil 113 changes, the frequency produced by the sensor 100 changes. The frequency output of the sensor 100 is counted by the counter 115 and continuously supplied to the comparators 117*a*, 117*b* and 117*c*. The comparators 117*a* to 117*c* compare the changing frequency with the reference value stored therein and thereupon continuously produce a signal "1" or "0" as results of the comparison as shown, for example, in FIG. 10. As a result, the hammer positions A, B, C and D are represented by data shown in the following Table:

TABLE

| | Comparator 117a | Comparator 117b | Comparator 117c |
|---|---|---|---|
| Position A | 0 | 0 | 0 |
| Position B | 1 | 0 | 0 |
| Position C | 1 | 1 | 0 |
| Position D | 1 | 1 | 1 |

These data are supplied to the controller 96 to enable it to perform the operations described in the previously described embodiments.

According to this embodiment, by prestoring, in comparators, oscillation frequencies of the sensor 100 produced at selection operation points of the hammer 75, any number of operation points of the hammer can be detected so that an accurate measuring of the hammer position is ensured and, besides, mechanical adjustment of the sensor becomes unnecessary.

What is claimed is:

1. A key-touch state detection device for an automatic performance musical instrument including a keyboard having a plurality of keys, at least one string, and at least one hammer which is operative to strike the at least one string in response to an operation of a corresponding key of the plurality of keys, the device comprising:

hammer position sensing means for sensing the hammer at at least two positions as the hammer travels a predetermined path in response to the operation of the corresponding key, a first position corresponding to a hammer stop position and a second position corresponding to a position in the vicinity of the string; and release time determining means, responsive to the hammer position sensing means, for determining a release time of the corresponding key based on the position of the hammer sensed by the hammer position sensing means.

2. A key-touch state detection device for an automatic performance piano comprising:

hammer position detection means for detecting whether or not a position of a hammer moving in a first direction toward a string in an interlocked motion with the movement of a key coincides with a predetermined hammer stop position and also whether or not a position of the hammer coincides with at least one predetermined position in the vicinity of the string, and for providing the results of the detection, the hammer position detection means including a sensor which can detect a hammer position continuously in the course of the movement of the hammer in an interlocked motion with the movement of the key, a first comparator for comparing the results of the detection by the hammer position detection means with the predetermined hammer stop position, and a second comparator for comparing the results of the detection by the hammer position detection means with the predetermined positions in the vicinity of the string; and determination means, responsive to the results of the detection by the hammer position detection means, for determining when the hammer is moving in a second direction away from the string on the basis of a state of change in the results of the detection by the hammer position detection means, and for subsequently determining a timing at which the hammer ceases to coincide with the predetermined hammer stop position.

3. A key-touch state detection device as defined in claim 2, wherein the sensor comprises a metal member provided on the hammer and an oscillator having a coil provided in the vicinity of the moving path of the hammer opposite to the metal member and producing an oscillation output, the first comparator compares the frequency of oscillation output by the sensor with a predetermined frequency corresponding to the hammer stop position, and the second comparator compares the frequency of oscillation output by the sensor with predetermined frequencies corresponding to the positions in the vicinity of the string.

* * * * *